United States Patent [19]

Cherry

[11] 4,253,206

[45] Mar. 3, 1981

[54] BODY SUPPORT FOR A CASKET

[76] Inventor: John R. Cherry, 1372 SW. Knollwood Dr., Palm City, Fla. 33490

[21] Appl. No.: 45,789

[22] Filed: Jun. 5, 1979

[51] Int. Cl.[3] ..... A47C 19/00

[52] U.S. Cl. ..... 5/82 R; 5/186 R; 5/431; 5/DIG. 1; 27/4

[58] Field of Search ..... 5/81 R, 82, 186 R, 431, 5/448, DIG. 1; 27/2, 4, 28; 206/45.19

[56] References Cited

U.S. PATENT DOCUMENTS

| | | | |
|---|---|---|---|
| 3,389,785 | 6/1968 | Lidgard | 206/45.19 |
| 4,139,918 | 2/1979 | Covington | 5/431 X |

*Primary Examiner*—Casmir A. Nunberg

*Attorney, Agent, or Firm*—Olsen and Stephenson

[57] ABSTRACT

An inexpensive, light weight body support adapted for use in a casket to support a corpse. The body support consists of a pair of bed sections which are formed from blanks of sheet material such as paper board and which are positioned end-to-end in the casket. When set up, each bed section has a generally flat top panel and depending upright side panels having vertical dimensions that decrease progessively from the head portion to the foot portion to support the corpse in an inclined position. The top panel is scored longitudinally enabling it to sag under the weight of the corpse to restrain its sideways movement in the casket. Triangularly shaped base members are disposed transversely of the bed sections in the casket to support the bed sections by engaging their side panels. A corpse whose weight exceeds a predetermined magnitude will cause the side panels to collapse around the base members lowering the corpse in the casket.

12 Claims, 8 Drawing Figures

BODY SUPPORT FOR A CASKET

BACKGROUND OF THE INVENTION

The present invention relates generally to burial caskets, and more particularly, to a body support for a casket to support a corpse in a recumbent position.

Conventional burial caskets include adjustable spring frames placed on the bottom of the casket for supporting the corpse as disclosed in U.S. Pat. No. 1,821,108. Such spring frames are adjustable to elevate and incline the corpse for viewing and thereafter to lower the corpse to a flat position for internment. Such body support mechanisms are complex, add substantial additional weight to the casket, and in view of their short-lived usefulness, unnecessarily increase the cost of the casket.

Other types of body supports have been developed including those used temporarily in transporting a corpse as shown in U.S. Pat. No. 4,123,831 which describes a disposable transportation casket constructed from blanks of fiberboard. However, the casket disclosed in this patent is not designed for and hence us unsuited for use as a conventional burial casket.

It is the object of this invention, therefore, to provide an improved body support for use in a burial casket.

It is another object of this invention to provide a body support formed from blanks of sheet material to support a corpse in an inclined position.

It is another object of this invention to provide a body support capable of supporting a variety of body weights and sizes at the proper vertical location in a casket.

It is another object of this invention to provide a body support operable to restrain sideways movement of a corpse in a casket.

SUMMARY OF THE INVENTION

In accordance with the present invention, an improved body support for use in a casket is provided comprised of a pair of bed sections formed from blanks of sheet material such as corrugated, double-faced paper board. When set up, each bed section includes a generally flat top panel and upright depending side and end panels. Each side panel has a vertical dimension that decreases progressively from the head portion toward the foot portion of the bed section so that a corpse disposed in a recumbant position on the body support will be inclined slightly with the upper portion of the body being elevated where it can be viewed.

The top panels of the bed sections have longitudinally extending score lines enabling the top panels to sag under the weight of the corpse thereby forming a generally concave surface. The sagging of the top panels functions to restrain sideways movement of the corpse on the body support. The score lines are located to establish a centered location where the sagging occurs to insure that the body is properly centered in the casket.

A plurality of base members are disposed sideways on the bottom of the casket to support the bed sections. Each base member has a triangular cross sectional configuration and the side panels of the bed sections rest on the apexes of the triangular base members. Since the side panels are formed of flexible sheet material, they can collapse around the apexes of the base members when the weight of the corpse exceeds a predetermined magnitude. The collapse of the side panels around the base members lowers the top panels and the corpse within the casket. Because there is a correlation between body size and body weight, the collapse of the side panels under heavy body loads insures that a heavier and larger body will be positioned low enough to enable the casket top to be closed while the lighter and therefore smaller bodies will be maintained at the proper viewing height within the casket.

Further objects, features and advantages of the present invention will become apparent from a consideration of the following description when taken in connection with the appended claims and the following drawing in which:

Figure 1:
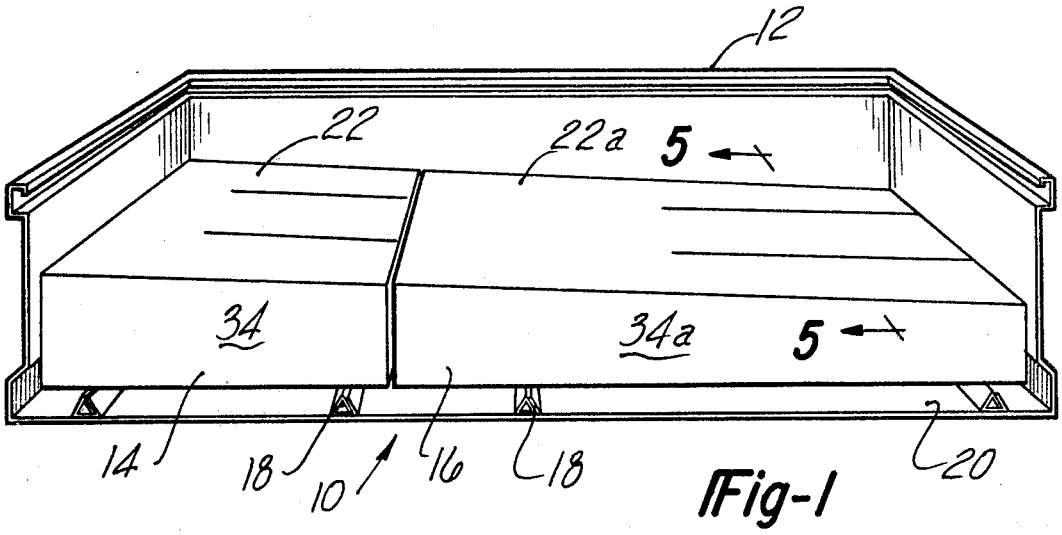
FIG. 1 is a perspective view of the body support of this invention installed in a casket which is shown illustrated with portions cut away for purposes of clarity.

Referring to the drawing, the body support of this invention, indicated generally at 10, is shown in FIG. 1 disposed in a casket 12. The body support 10 includes a head bed section 14, a foot bed section 16, and a plurality of base members 18 disposed sideways on the bottom 20 of the casket 12 extending transversely of and in supporting relation with the bed sections 14 and 16. The bed sections 14 and 16 and the base members 18 are formed from blanks of sheet material such as double-faced corrugated paper board, fiberboard or from other materials such as semi-rigid plastic. Preferably, paper board is used because it is inexpensive and is easy to work with.

Figure 6:
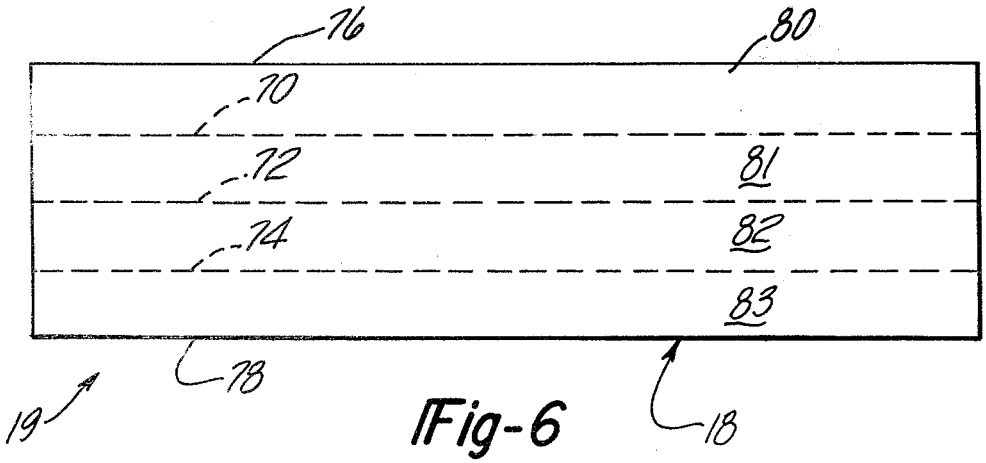
FIG. 6 is a plan view of a blank used to form a base member of the body support of this invention.
Figure 7:
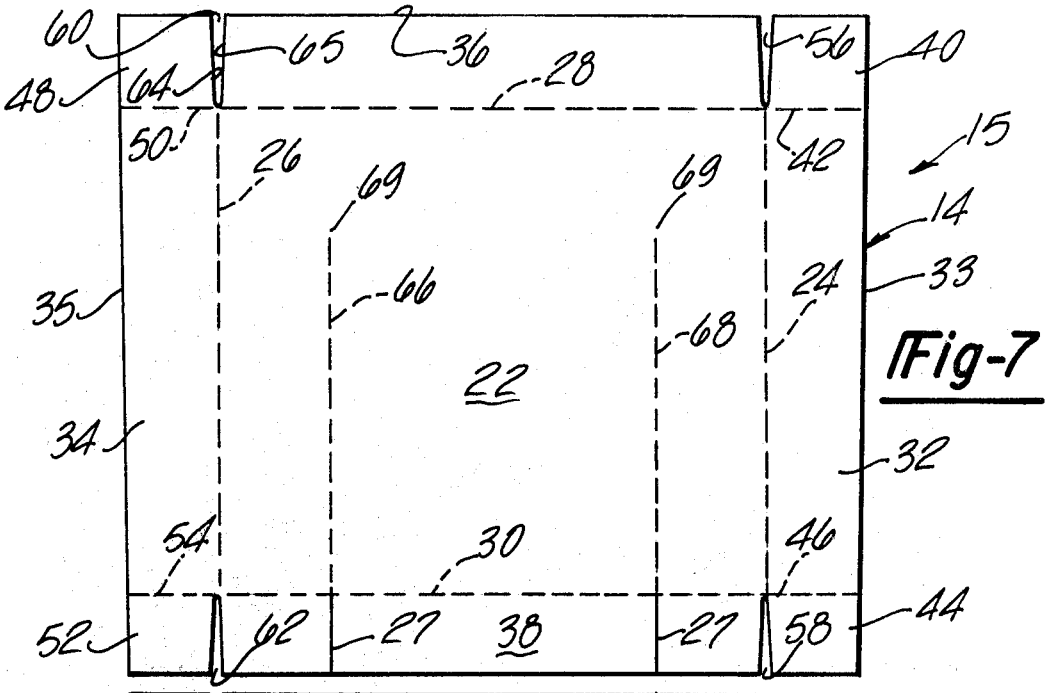
FIG. 7 is a plan view of a blank used to form the head bed section of the body support of this invention.
Figure 8:
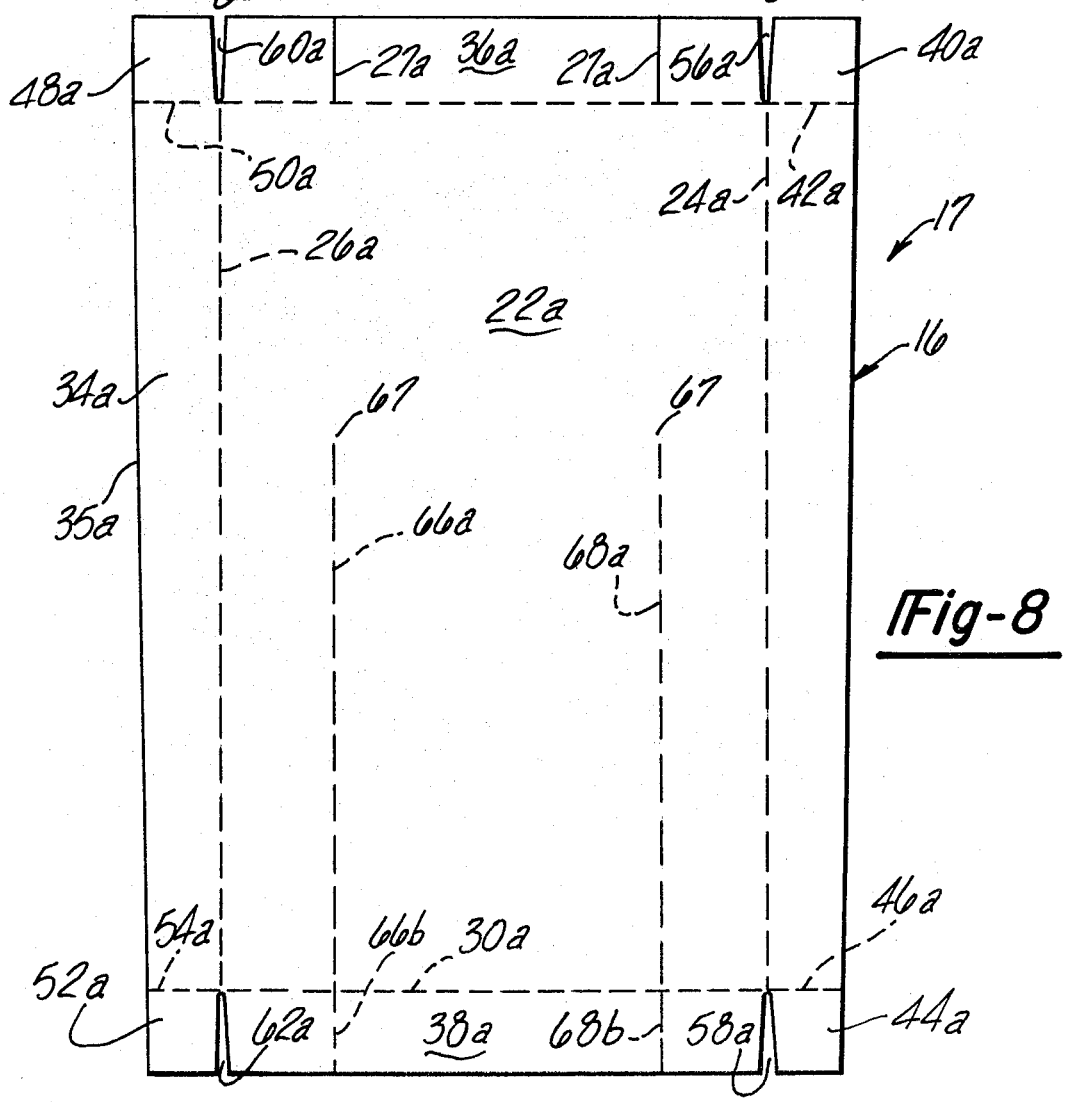
FIG. 8 is a plan view of a blank used to form the foot bed section of the body support of this invention.

The blanks used to form the head bed section 14 and the foot bed section 16 are shown at 15 and 17 in FIGS. 7 and 8, respectively, with the blank 19 used to form one of the base members 18 being shown in FIG. 6. The head bed section blank 14 includes a rectangular top panel or portion 22 bordered by parallel side edge score or fold lines 24 and 26 and by parallel end edge fold or score lines 28 and 30 which extend transversely of the section 14 perpendicular to the score lines 24 and 26. Side panels 32 and 34 are foldably and integrally attached at one side edge thereof to the central panel 22 by the score lines 24 and 26, respectively. Similarly, end panels 36 and 38 are foldably and integrally attached to the central or top panel 22 by the fold lines 28 and 30, respectively.

Figure 5:
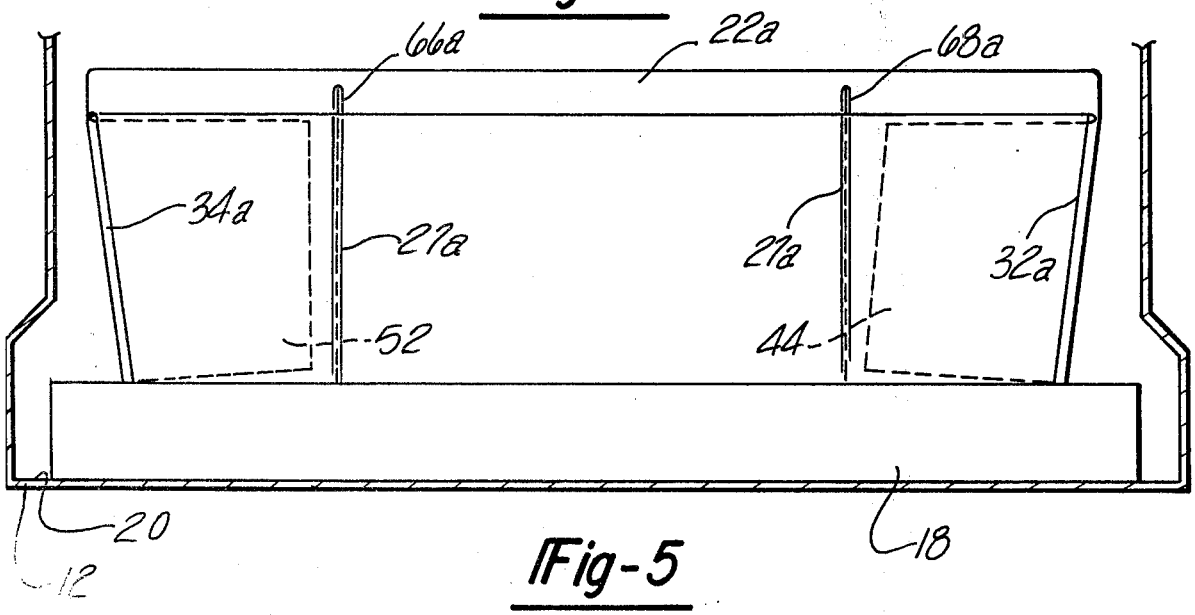
FIG. 5 is a sectional view of a bed section of the body support of this invention taken substantially from line 5—5 in FIG. 1.

Connecting tabs 40, 44, 48 and 52 form extensions of the side panels 32 and 34. The connecting tab 40 is foldably and integrally attached to the side panel 32 by a score line 42 and the connecting tab 44 is foldably and integrally attached to the opposite end of the side panel 32 by the score line 46. It can be seen from FIG. 7 that the score lines 42 and 46 are extensions of the score lines 28 and 30 when forming the blank 14. Similarly, the connecting tabs 48 and 52 are foldably and integrally attached to the side panel 34 by the score lines 50 and 54, respectively, which are extensions of the score line 28 and 30. The connecting tabs 40, 44, 48 and 52 are separated from their respective end panels 36 and 38 by V-cuts 56, 58, 60 and 62 formed in the blank 15 in alignment with the score lines 24 and 26. The V-cuts form edges 64 and 65 in the end panels 36 and 38 which diverge in directions extending longitudinally away from the panel 14. The purpose of the V-cuts is to locate the edges 65 at positions in which they are inclined downwardly toward each other when the end panels 36 and 38 are folded downwardly to upright positions. When the side panels 32 and 34 are folded downwardly into alignment with the edges 65 they likewise will extend downwardly from the panel 22 toward each other so as to be inclined inwardly. As seen in FIG. 5, the connecting tabs 40, 44, 48 and 52 are folded generally perpendicularly to the side panels 32 and 34 to lie against the end panels 36 and 38 when the bed section 14 is set up and are attached to the inside surfaces of the end panels 36 and 38 by stapling, an adhesive or any other appropriate means.

A pair of parallel longitudinally extending score lines 66 and 68 are formed in the top panel 22 of the blank 15 forming the head bed section 14 and extend perpendicularly from the fold line 30 toward the fold line 28 terminating at the approximate locations (indicated at 69) where the shoulder blades of the body engage the top panel 22. Thus, the distance between the score lines 66 and 68 is approximately equal to the distance between the shoulder blades on a body. The score lines 66 and 68 enhance the ability of the top panel 22 to sag when a body is placed on the support 10 and define the flexing of the top panel 22 to its concave shape at a centered location between the side panels 32 and 34. The cooperation of the score lines 66 and 68 and the shoulder blades of the body define the most advantageous sag location that offers the greatest stability for the corpse.

The blank 15 is cut along its sides to form edges 33 and 35 which converge in directions extending from the fold line 28 toward the fold line 30 so that when the side panels 32 and 34 are folded downwardly and placed on the flat supporting surface the head portion (the area adjacent the fold line 28) will be positioned above the foot portion of the bed section 14 (the area of the top panel 22 adjacent the fold line 30). Accordingly, the top panel 22 is inclined when the bed section is set up with the height of the side panels 32 and 34 descreasing progressively from the head to foot portions of the bed section 14.

The foot bed section 16 is constructed in a manner similar to the construction of the head bed section 14. The top, side and end panels, score lines and connecting tabs of the bed section 16 which correspond to those components of the head bed section 14 will be designated by like numerals with the addition of a suffix "a". The foot bed section 16 is formed from a blank 17 of paperboard (FIG. 8) and includes a top portion or panel 22*a* bordered by side score lines 24*a* and 26*a* and by end score lines 28*a* and 30*a*. A side panel 32*a* is foldably and integrally connected with the top panel 22*a* by the score line 24*a*, an opposite side panel 34*a* is integrally and foldably attached to the top panel 22*a* at the score line 26*a*. Likewise, end panels 36*a* and 38*a* are foldably and integrally attached to the panel 22*a* at the score lines 28*a* and 30*a*, respectively. Connecting tabs 40*a* and 44*a* are foldably attached to the side panel 32*a* by score lines 42*a* and 46*a* which are extensions of the score lines 28*a* and 30*a*. Connecting tabs 48*a* and 52*a* are integrally and foldably attached to the side panel 34*a* at the fold lines 50*a* and 54*a* which are extensions of the score lines 28*a* and 30*a*. V-cuts 56*a*, 58*a*, 60*a*, and 62*a* are made in the blank 17 in alignment with their respective score lines 26*a* and 32*a* to separate the tab members from the end panels 36*a* and 38*a*.

The foot bed section 16 is set up in the same manner as is the head bed section 14. The foot bed section 16 differs from the head bed section 14 in that it is longer than the head bed section 14 and has shorter side panels 32*a* and 34*a*. The blank 17 has side edges 33*a* and 35*a* converging in directions extending from the fold line 28*a* toward the fold line 30*a* so that when the side panels 32*a* and 34*a* are folded to upright positions and the bed section 16 is supported on a flat surface the top panel 22*a* will be inclined like the top panel 22.

The height of the side panels 32*a* and 34*a* at the fold lines 42*a* and 50*a* are approximately equal to the height of the side panels 32 and 34 on the bed section 14 at the fold lines 46 and 54. The height of the side panels 32*a* and 34*a* decreases progressively at the same rate with which the height of the side panels 32 and 34 decrease so that when the bed sections 14 and 16 are placed end-to-end the top panels 22 and 22*a* will be in substantial planar alignment.

The foot bed section 16 has score lines 66*a* and 68*a* extending from the score line 30*a* toward the score line 28*a* and terminating at positions where the middle of the thighs of the body would lie. Thus, the distance between the score lines 66*a* and 68*a* is approximately equal to the distance between the middle of the thighs.

The end panel 38*a* has score lines 66*b* and 68*b* which are aligned with the score lines 66*a* and 68*a*. The score lines 66*b* and 68*b* allow the feet of the body to depress the end panel 38*a* to establish a sufficient clearance between the casket top (not shown) and the feet of the corpse.

Parallel cuts 27 are made in the end panel 38 of the bed section 14 in alignment with the score lines 66 and 68. When the end panel 38 is folded upright and a body is placed on the top panel 22 the cuts 27 enable the end panel 38 to collapse thereby allowing the top panel 22 to sag at the fold line 30. Cuts 27*a* are made in the end panel 36*a* of the foot bed section 16. The cuts 27*a* are parallel, spaced apart a distance between the cuts 27 and, like the cuts 27, extend from the edge of the end panel 36*a* to the fold line 28*a*.

Figure 3:
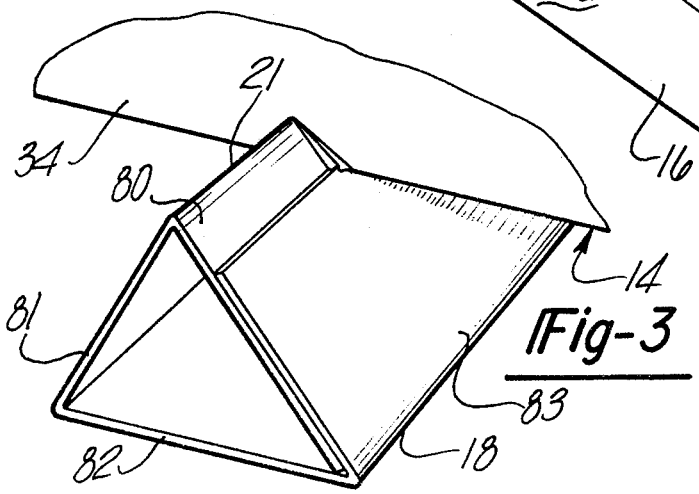
FIG. 3 is a fragmentary view of the body support shown in FIG. 2 illustrating the collapse of the side walls around a supporting base member.

The base members 18 are formed from blanks 19 of sheet material such as double-faced corrugated paper board, indicated in FIG. 6. The blank 19 forming the base member 18 is generally rectangular in shape having a longitudinal dimension that is adquate to extend sideways accross the bed sections 14 and 16 beyond the upright side panels 32, 34, 32*a* and 34*a*. Three score lines 70, 72, and 74 are made in the blank 19 extending longitudinally thereof. The distance from the edge 76 of the base member blank to the fold line 70 is essentially equal to the distance between the score line 70 and 72 and to the distance between the score line 72 and 74. However, the distance between the score line 74 and the other edge 78 of the blank is less than the other distances. The base member 18 is assembled by folding the blank 19 to form a triangular base member 18 having a hollow interior and panels 80, 81, 82 and 83, as seen in FIG. 3. The opposite end panels 80 and 83 overlap with the narrower panel 83 lying face-to-face with the wider panel 80. A suitable adhesive or staples are used to secure the panels 80 and 83 together. The overlapping of the panels 80 and 83 facilitates the assembly of the base members 18 and adds structural strength.

Figure 2:
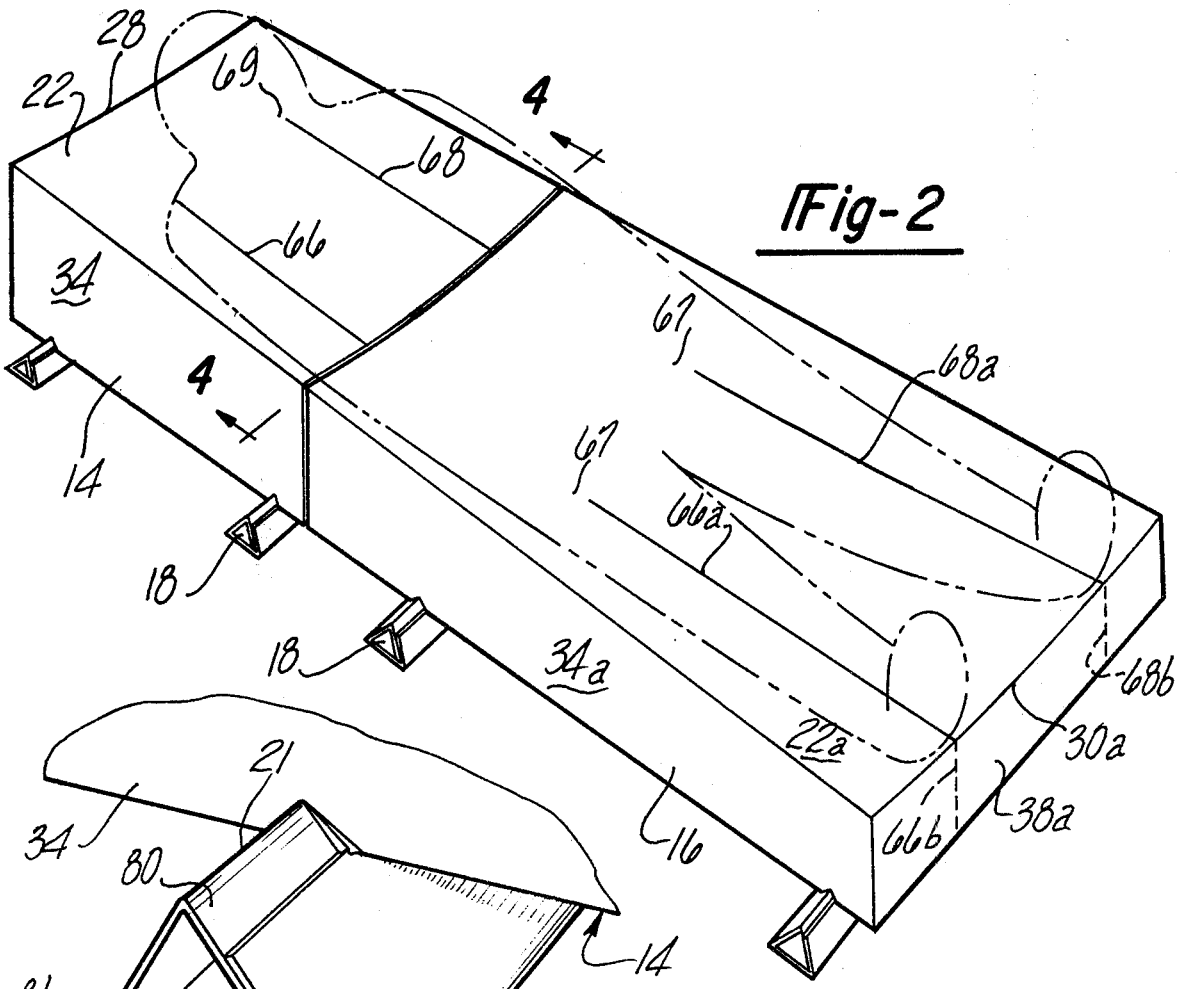
FIG. 2 is a perspective view of the body support of this invention showing in broken lines a body disposed thereon.

As seen in FIGS. 1 and 2, the base members 18 are positioned sideways in the casket 12 on its bottom wall 20. The bed sections 14 and 16 are positioned end-to-end on the base members 18 with the edges 33, 35, 33*a* and 35*a* of the side panels 32, 32*a*, 34, 34*a* resting on the apexes 21 of the base member 18.

Figure 4:
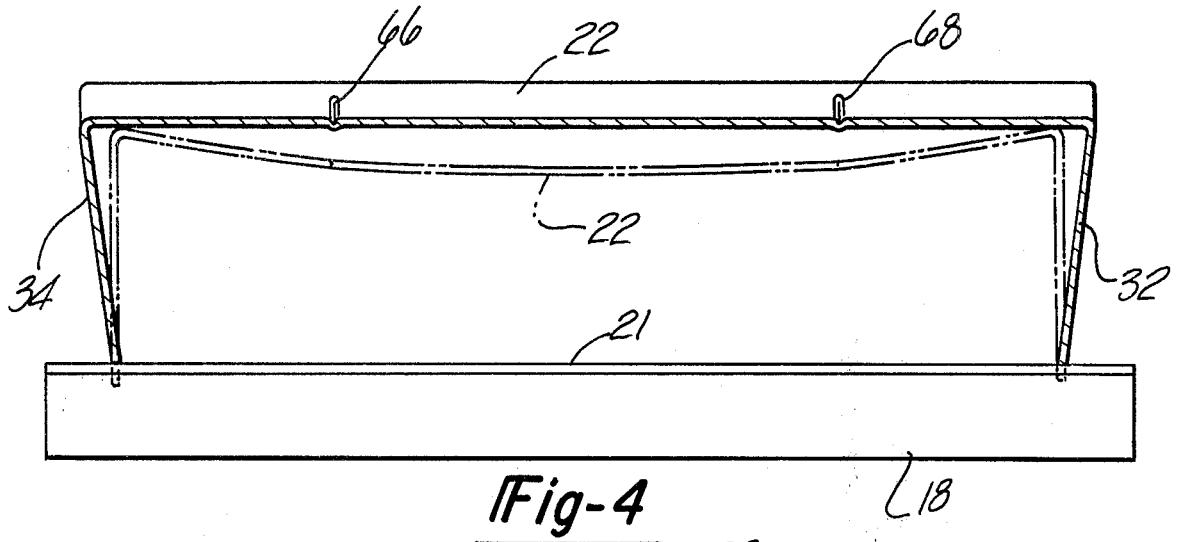
FIG. 4 is a sectional view of a bed section of the body support of this invention taken substantially from line 4—4 in FIG. 2.

FIGS. 4 and 5 show in solid lines the end view configuration of the bed sections 14 and 16 when not subjected to a load. FIG. 4 shows in broken line the sagging of the top panel 22 under load with the score lines 66 and 68 defining the longitudinal centered position of the concave surface. The side walls 32 and 34 are also bent inwardly to a more upright position under a load. Because the side panels 32 and 34 are initially inclined downwardly from the top panel 22 toward each other and they are moved toward a more upright position under load they are above to support the corpse without buckling or collapsing at the fold lines 24 and 26, as the compressive strength of the side panels is effectively utilized.

The body support 10 is installed in a casket 12 by first setting up the head and foot bed sections 14 and 16 and a plurality of base members 18, four being used in the installed embodiment. The base members 18 are placed sideways in parallel spaced apart positions on the bottom 20 of the casket 12 and the head and foot bed sections 14 and 16 are positioned end-to-end on the base member 18 with the end panels 38 and 36*a* positioned face-to-face so that the top panels 22 and 22*a* are inclined in generally planar alignment. Two base members 18 support the head bed section 14 and two base members 18 support the foot bed section 16. Of course, suitable lining (not shown) will cover the bed sections 14 and 16.

Positioning of a corpse in a recumbant position on the body support 10 will produce the following reactions. First, the top panels 22 and 22*a* will sag with the score lines 66, 68, 66*a* and 68*a* forming weakened portions in the top panels 22 and 22*a* which define the sagging action. As noted above, the score lines 66 and 68 extend from the score line 30 terminating at the approximate location 69 where the shoulder blades engage the top panel 22. Thus, the shoulder blades of the body initiate the sagging of the top panel with the score lines 66 and 68 enabling the sagging of the top panel 22 to continue along defined longitudinal paths. Similarly, the score lines 66*a* and 68*a* extend from the fold line 30*a* to the positions 67 where the middle of the thighs would rest thereby enabling the sagging to follow defined longitudinal paths.

The cuts 27 and 27*a* in the end panels 38 and 36*a* enable the end panels 38 and 36*a* to collapse so that the portions of the top panels 22 and 22*a* adjacent the end panels 38 and 36*a* will be able to sag. The end panels 38 and 36*a*, although collapsed still provide needed support to the body. Thus, the body is supported on the body support in an inclined position from which unintended sideways movement is inhibited by the concave configuration of the top panels 22 and 22*a*. As seen in FIG. 4, the sagging of the side panels 22 and 22*a* pulls the side panels 32, 34, 32*a* and 34*a* into more upright positions thereby insuring that their maximum supporting capability is utilized.

The score lines 66*b* and 68*b* in the end panel 38*a* of the bed section 16 will be in alignment with the feet of the corpse. The score lines 66*b* and 68*b* allow the end panels 38*a* and the portions of the top panel 22*a* adjacent to the end panel 38*a* to form recesses (not shown) for the feet insuring that sufficient clearance between the feet and the casket top will be provided.

If the weight of the corpse exceeds a predetermined magnitude, 150 pounds for example, the side panels will collapse or crush around the base members 18 causing the body to be lowered within the casket. Thus, adequate room will be provided above the body for closing the casket top.

Many blanks 15, 17 and 19 which form the bed support 10 can be shipped in a relatively small space. Accordingly, those costs associated with shipping and storage are significantly reduced.

The side panels of the bed sections 14 and 16 cooperate with the base members 18 to enable a variety of body sizes and body weights to be supported by the body support 10. As mentioned above, a body weight above a predetermined magnitude will cause the side panels 32, 34 32*a* and 34*a* to collapse or crush around the apexes 21 of the base members 18. Above the predetermined magnitude, the amount of collapse of the side panels around the base members 18 will depend on the weight of the body. In other words, a heavier body will cause a greater collapse or crushing of the side panels around the base members 18. Since a body of greater weight will have a corresponding greater size, the crushing action of the side panels will lower the top panels 22 and 22*a* toward the bottom of the casket 12 thereby lowering the body to insure that the casket top (not shown) can be closed. On the other hand, a lighter body being of smaller size will not be lowered to such an extent and thus will be at the proper height within the casket 12 for viewing purposes.

As can be seen from the above description, a versatile body support is provided utilizing inexpensive sheet material. Employment of the body support 10 of this invention will minimize the cost of a burial casket without diminishing its ability to accommodate a variety of body weights and sizes.

What is claimed:

1. A body support comprising a plurality of bed sections disposed end-to-end on a supporting surface to support a body in a recumbent position above said surface, each of said bed sections including a top support portion and integral depending upright side portions extending downwardly below said top portion, said top portion being formed of sheet material operable to sag under the load of a body positioned on said top portion to thereby form a concave top surface extending between said side portions to restrain sideways movement of said body, and transverse base members extending transversely of said body support and interposed between said bed sections and said support surface to engage said side portions, said side portions being collapsible around said transverse base members in response to a downward body load above a predetermined magnitude to lower said top portion toward, said supporting surface.

2. The body support according to claim 1, wherein the amount of side portion collapse and the corresponding downward displacement of said top portions are dependent upon the magnitude of the downward body load on said bed sections.

3. The body support according to claim 1, wherein each of said base members has a triangular cross section with its apex facing upwardly to engage said side portions thereby facilitating the collapse of said side portions around said base member in response to a downward body load.

4. The body support according to claim 1, and further including a plurality of longitudinally extending score lines formed in said top portion establishing weak portions in said top portion operable to define a centered position of said concave top surface between said side portions.

5. The body support according to claim 1, wherein each of said bed sections includes integral depending upright end portions extending downwardly below said top portion, means on at least one of said end portions operable to enable said end portion to bend under a downward body load.

6. The body support according to claim 5, wherein said end portions have cuts formed therein enabling said end portion to yield to said body load.

7. A kit for constructing a body support, said kit comprising a plurality of bed section blanks formed from a sheet material, each of said bed section blanks having a pair of longitudinally extending score lines and a pair of transversely extending score lines dividing said bed section blank into a plurality of panels whereby said bed section blank can be folded along said score lines to form a generally rectangular flexible top panel having integral side and end panels extending downwardly below said top panel, each of said bed section blanks having longitudinally extending side edges slanting toward each other from one end panel to the other end panel, so that said top panel is inclined when said bed section is assembled and disposed on a supporting surface, and auxiliary longitudinally extending score lines in said top panel located between said first mentioned longitudinally extending score lines, said top panel being operable to sag under a downward body load to form a concave top surface, said auxiliary longitudinally extending score lines being operable to define the location at which said side panel forms said concave top surface between said side portions.

8. The kit according to claim 7, and further including a plurality of base member blanks formed from sheet material, said base member blanks each having at least two longitudinally extending score lines dividing said base member blank into at least three panels whereby said base member blank can be folded along said score lines to form a base member having a triangular cross section and a hollow interior, said base members being positionable transversely of said bed sections in a supporting relationship therewith in which said side portions rest on the apexes of said triangular base members so that a downward body load above a predetermined magnitude will collapse said side portions around said base members lowering the vertical position of said top panels of said bed sections.

9. The kit according to claim 8, wherein said base member blank has three longitudinally extending score lines, defining four panels, said base member blank being foldable along said score lines to form a base member having a triangular cross section with a hollow interior, the end ones of said panels being overlapped to facilitate retention of said base member in said triangular configuration.

10. A body support for supporting a body in a recumbent position on a supporting surface, said body support being formed from a blank of sheet material and having a top panel with integral side and end portions extending downwardly from said top panel, a plurality of base members positionable on a supporting surface and extending transversely of said body support, said side portions resting on said base members and being at least partially collapsible so that a downward body load of a predetermined magnitude will collapse the side portions around said base members to lower the top panel relative to said supporting surface.

11. A body support comprising a plurality of bed sections arranged end-to-end on a supporting surface to support a body in a recumbent position above said surface, each of said bed sections including a top support portion and integral depending upright side portions extending downwardly below said top portion, said upright side portions of each of said bed sections having corresponding heights that progressively diminish from one end to the other end thereof so that said top portion is inclined with respect to said supporting surface with one end being elevated above the other end, said bed sections being arranged so that the shorter end of one bed section is positioned adjacent to the taller end of the adjacent bed section, said side portions of said bed sections having selected heights so that when said bed sections are arranged end-to-end said top portions cooperatively form a uniformly inclined support surface on which a body is supported in an inclined position, said top portions being formed of sheet material and being operable to sag under the load of a body so that said support surface forms a concave configuration between said side portions to restrain sideways movement of said body.

12. The body support according to claim 11 wherein each of said bed sections includes end panels depending from said top portion, selected ones of said end panels having means enabling said selected end panels to collapse in reponse to the application of a load thereto.

* * * * *

UNITED STATES PATENT AND TRADEMARK OFFICE

CERTIFICATE OF CORRECTION

PATENT NO. : 4,253,206

DATED : March 3, 1981

INVENTOR(S) : John R. Cherry

It is certified that error appears in the above-identified patent and that said Letters Patent are hereby corrected as shown below:

Column 8, line 55, insert the following claim:

13. The body support according to claim 11 further including means at adjacent ends of adjacent bed sections engageable with said supporting surface to maintain said ends at substantially the same height.

On the title page after the Abstract, "12 Claims" should read -- 13 Claims --.

Signed and Sealed this

Ninth Day of June 1981

[SEAL]

Attest:

RENE D. TEGTMEYER

Attesting Officer

Acting Commissioner of Patents and Trademarks